United States Patent [19]

Lancet et al.

[11] 4,334,894

[45] * Jun. 15, 1982

[54] PROCESS FOR PRODUCING SYNTHESIS GAS FROM WOOD

[75] Inventors: Michael S. Lancet; George P. Curran, both of Pittsburgh, Pa.

[73] Assignee: Conoco Inc., Stamford, Conn.

[ * ] Notice: The portion of the term of this patent subsequent to Nov. 4, 1997, has been disclaimed.

[21] Appl. No.: 139,915

[22] Filed: Apr. 14, 1980

Related U.S. Application Data

[63] Continuation-in-part of Ser. No. 20,005, Mar. 12, 1979, Pat. No. 4,231,760.

[51] Int. Cl.[3] ..... C10J 3/12; C10J 3/54

[52] U.S. Cl. ..... 48/209; 252/373

[58] Field of Search ..... 48/197 R, 202, 206, 48/209; 252/373, 443, 455 R, 457; 423/230

[56] References Cited

U.S. PATENT DOCUMENTS

| | | | |
|---|---|---|---|
| 3,115,394 | 12/1963 | Gorin et al. | 48/202 |
| 3,740,193 | 6/1973 | Aldridge et al. | 48/209 |
| 3,775,072 | 11/1973 | White | 48/202 |
| 4,231,760 | 11/1980 | Lancet et al. | 48/202 |

*Primary Examiner*—Peter F. Kratz

*Attorney, Agent, or Firm*—Dale Lovercheck; William A. Mikesell, Jr.

[57] ABSTRACT

In a process for producing synthesis gas by reacting a solid carbonaceous fuel with water in the presence of a carbon dioxide acceptor to produce a synthesis gas rich in hydrogen with at least a portion of the carbon dioxide so produced being reacted with the carbon dioxide acceptor to produce calcium carbonate and to provide sufficient heat to maintain a desired reaction temperature, an improvement comprising; the use of finely-divided wood as the solid carbonaceous fuel.

4 Claims, 1 Drawing Figure

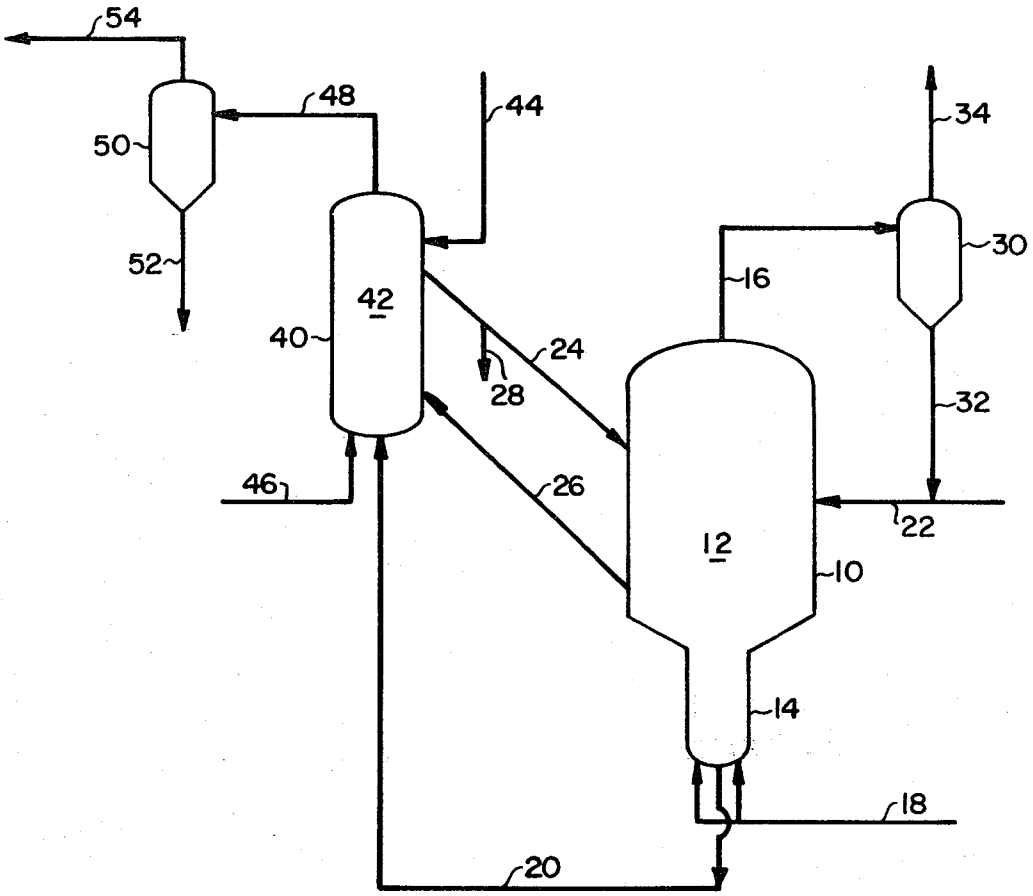
34
30
32
22
10
18
16
12
14
24
26
28
20
44
42
48
40
46
54
50
52

PROCESS FOR PRODUCING SYNTHESIS GAS FROM WOOD

This is a continuation-in-part of U.S. Ser. No. 20,005 filed Mar. 12, 1979, now U.S. Pat. No. 4,231,760 issued Nov. 4, 1980.

This invention relates to the production of a synthesis gas from wood.

This invention further relates to the production of synthesis gas from wood by reacting the wood with steam in the presence of a $CO_2$ acceptor.

This invention further relates to the use of synthetic $CO_2$ acceptors in the reaction of steam and wood to produce synthetic gaseous fuels.

In view of the continuing and well-known shortage of natural gas, a continuing effort has been directed to the development of processes whereby synthetic gaseous fuels can be produced from other more abundant fuels such as coal and the like. One such process comprises the reaction of steam with carbonaceous fuels, such as coal, in the presence of a $CO_2$ acceptor material such as calcium oxide to produce synthetic fuels which are rich in hydrogen. Some processes of this type are disclosed in the following U.S. Pat. Nos.:

| | | |
|---|---|---|
| U.S. Pat. No. | 2,654,661 | Gorin |
| | 2,654,662 | Gorin |
| | 2,654,663 | Gorin |
| | 2,682,455 | Gorin |
| | 2,682,456 | Gorin |
| | 2,682,457 | Gorin |
| | 2,705,672 | Gorin |
| | 2,781,248 | Gorin |
| | 2,807,529 | Tarbox |
| | 3,108,857 | Gorin et al. |
| | 3,115,394 | Gorin et al. |
| | 3,188,179 | Gorin |
| | 3,194,644 | Gorin et al. |
| | 3,516,808 | Curran et al. |

In the preparation of the present application, the following references were also considered.

| | | |
|---|---|---|
| U.S. Pat. No. | 1,574,380 | Endres |
| | 2,057,402 | Tropsch |
| | 2,234,367 | Chesny |
| | 3,141,729 | Clarke |
| | 3,847,837 | Boryta |
| | 3,865,924 | Gidaspow |

U.S. Pat. No. 4,191,538 and U.S. patent application Ser. Nos. 20,004; 20,005 and 124,199 disclose synthetic $CO_2$ acceptors.

These references are hereby incorporated by reference.

In the practice of such processes, a continuing problem has been the tendency for the calcium oxide to become inactive after several cycles through the process. While there may be many contributing factors to the inactivity of the calcium oxide after repeated cycling through the process, at least one major factor is the growth of the crystal size of the calcium oxide to the extent that the surface area is greatly reduced. Such inactivation can be compensated for by one of three routes; one, remove some "spent" acceptor from the process and replace it with fresh natural acceptor, or two, remove spent natural acceptor from the process and reconstitute it by heat treatment, chemical processing, or the like. The third alternative resides in our earlier development of synthetic $CO_2$ acceptors which can be reconstituted without being removed from the process.

Although we emphasize throughout this disclosure the utilization of synthetic $CO_2$ acceptors, it will become apparent to one skilled in the art, upon study of this specification, that naturally occurring limestones and dolomites are satisfactory acceptors for purposes of this invention.

It has now been found that synthesis gas is readily produced from finely-divided wood by reacting the wood with steam in the presence of a $CO_2$ acceptor to produce a synthesis gas rich in hydrogen with at least a major portion of the $CO_2$ so produced being reacted with the $CO_2$ acceptor to produce calcium carbonate and to provide sufficient heat to maintain a desired reaction temperature. Wood has a low ash and sulfur content and is well-suited to use with synthetic $CO_2$ acceptors. Further the char produced from the gasification of wood is suitable for use in such processes.

The FIGURE is a schematic diagram of a process wherein the use of the synthetic acceptor of the present invention is effective.

In the FIGURE, a reactor 10 is shown. Reactor 10 contains a fluidized bed 12 and includes a standpipe 14 which comprises a reduced diameter section positioned at the lower portion of reactor 10. A gas inlet 18 for the injection of fluidizing gas which is normally steam is provided for maintaining fluidized bed 12 in a fluidized condition. Finely-divided wood is introduced into reactor 10 through a line 22 and regenerated or fresh $CO_2$ acceptor (calcium oxide) is introduced into reactor 10 through a line 24. A product gaseous stream is recovered from reactor 10 via a line 16 and passed to a solids/gas separating means such as a cyclone 30 from which the gaseous mixture is recovered through a line 34 and passed to further processing with the entrained solids being recovered from cyclone 30 through a line 32 and passed to line 22 for recycle to reactor 10. A stream comprising calcium carbonate is recovered from the lower portion of reactor 10 via a line 20 and passed to a regenerator 40 which contains a fluidized bed 42. An air inlet line 46 is provided for the introduction of free oxygen-containing gas into fluidized bed 42 and char is introduced into fluidized bed 42 via a line 26 from reactor 10. The amount of oxygen introduced into fluidized bed 42 is controlled to regulate the temperature in fluidized bed 42 and a flue gas mixture which contains, as entrained solids, a major portion of the ash produced by the combustion of wood in reactor 10 and regenerator 40 is recovered from regenerator 40 through a line 48 and passed to a solids/gas separator such as a cyclone 50 where a flue gas stream 54 is separated and passed to waste, further processing or the like with a solids stream comprising ash, calcium sulfide and the like being recovered through a line 52 and passed to waste disposal, further processing or the like. Fresh acceptor may be introduced into regenerator 40, line 24, reactor 10 or line 20 and is shown for convenience as being introduced via a line 44 into regenerator 40. Spent acceptor can also be withdrawn in a similar fashion and is shown for convenience as being withdrawn via a line 28 from line 24. In the operation of the process shown in the FIGURE, finely-divided wood is injected in an amount sufficient to maintain a fluidized bed of carbonaceous material in reactor 10. The wood is desirably of a size consist less than about 4 Tyler mesh and desirably smaller than about 8 Tyler mesh. A desirable size is from about 100 to about 8 Tyler mesh. The wood may be of any type and may be bark, twigs, chips etc. The wood is desirably dried to a water content less than about 2.0 weight percent. In reactor 10, the wood reacts with steam injected through line 18 to produce a gas which is rich in hydrogen. Typically, the gas comprises hydrogen and carbon monoxide in a ratio of approximately 3 mols of hydrogen per mol of carbon monoxide. This ratio is desirable for use in producing substitute natural gas such as methane or the like. In reactor 10, the reactions occurring can be shown as follows:

$$C+H_2O \rightarrow CO+H_2 \quad (1)$$

$$2C+H_2O+H_2 \rightarrow CH_4+CO \quad (2)$$

$$CaO+CO_2 \rightarrow CaCO_3 \quad (3)$$

Additional reactions occurring are the shift reaction;

$$CO+H_2O \rightarrow CO_2+H_2 \quad (4)$$

and the removal of sulfur compounds by reactions such as $$CaO+H_2S \rightarrow CaS+H_2O \quad (5)$$

As is clear to those skilled in the art, a variety of reactions is occurring in reactor 10 and the net result, as indicated, is the production of a synthesis gas which is rich in hydrogen. The reaction of calcium oxide with the carbon dioxide is exothermic and produces sufficient heat to maintain the desired reaction temperature in reactor 10. The calcium carbonate compounds removed via line 20 are passed to regenerator 40 where they are heated to a temperature sufficient to convert the calcium carbonate back to calcium oxide which is then recycled via line 24 to reactor 10. The calcium compounds can be considered as cascading downwardly through fluidized bed 12 as they absorb carbon dioxide and are recovered in a substantially pure form via line 20 since they are particulate in form and are denser than the carbonaceous compounds which are maintained in a fluidized condition by the injection of steam via line 18.

Reaction conditions in reactor 10 are typically below about 1550° F. (845° C.) with the steam pressure in standpipe 14 being controlled at values below about 13 atmospheres. Such is normally necessary since it is desired to minimize or eliminate the melting of the calcium compounds which occurs more readily in the presence of steam because of the formation of a calcium oxide-calcium hydroxide-calcium carbonate low melting eutectic complex in standpipe 14. The temperature in regenerator 40 is desirably in excess of about 1800° F. (980° C.) and is typically about 1850° F. (1005° C.).

By the use of synthetic acceptors as discussed in the references incorporated by reference above, the steam pressure in standpipe 14 is increased so that the low melting eutectic complex referred to above, forms and is melted. Since the calcium compounds present in the synthetic acceptor are contained in a thermally stable matrix, the calcium compounds, even though melted, remain in discrete particles, i.e. in the thermally stable matrix. Such permits the reactivation of the calcium compounds in the synthetic acceptor with each passage through the process thereby eliminating the need for large quantities of fresh make-up acceptor as has been the case with the naturally-occurring $CO_2$ acceptor materials used previously.

Such synthetic acceptors are suitably produced by mixing calcium carbonate and silica to produce a mixture containing from about 85 to about 90 weight percent calcium carbonate and from about 10 to about 15 weight percent silica. This mixture is then pelletized by forming an aqueous putty-like mixture and producing particles of a desired size. The particles are then heated to a temperature of at least 1500° F. (815° C.) for at least 30 minutes at a steam pressure of at least about 18 atmospheres and a carbon dioxide pressure of at least about 2 atmospheres to produce the synthetic $CO_2$ acceptor. In some instances it may be desirable to pelletize the mixture and produce pellets of a larger size than desired which are then ground to a desired size. It may also be desirable to heat the resulting particles to a temperature of at least about 1600° F. (870° C.) at a carbon dioxide pressure of at least about one atmosphere for at least about 30 minutes to partially harden the particles prior to heating under the steam pressure noted above. While in some instances it may not be necessary to heat at varying steam pressures, it is believed that in other instances it may be desirable to utilize the lower steam pressure partial hardening to ensure that the particles remain as discrete particles and the like. The resulting particles comprise a matrix of $Ca_5(SiO_4)_2CO_3$ as a matrix wherein calcium carbonate in an amount up to about 50 weight percent based on the weight of the particles is dispersed. The calcium carbonate positioned in the matrix is the acceptor material and would be calcined to calcium oxide prior to use in reactor 10. It may be desirable in some instances to further react the surface calcium of the particles so produced with silica in order to increase particle hardness and thereby increase resistance to attrition and also to increase the particle integrity during internal melting of the $CO_2$ acceptor.

In the use of wood a renewable resource is substituted for a non-renewable carbonaceous mineral resource. Further, waste wood may be used i.e. not only is wood of a grade suitable for lumber etc. usable, but bark, chips, twigs etc. may also be used.

As is known to the art, higher rank coals are not sufficiently reactive for use in processes such as discussed above since such coals require gasification temperatures greater than about 1750° F. (955° C.). The use of a $CO_2$ acceptor to generate the required heat is much less effective at such temperatures and is generally not considered suitable above temperatures of about 1550° F. (845° C.). Lignites and lower rank coals are readily gasified by such processes.

It has now been found that wood is also sufficiently reactive for conversion to synthesis gas in such processes. Further, the particulate char produced during the gasification of wood is stable at reaction conditions so that the char remains in bed 12 and is usable in regenerator 40 to regenerate the $CO_2$ acceptor. Further, wood is low in ash and in sulfur, both of which are detrimental to the $CO_2$ acceptor life.

As discussed above, conventional $CO_2$ acceptors have a limited useful life which may be extended when synthetic $CO_2$ acceptors are used. Ash and sulfur in the feed to the process are detrimental to the acceptor, either conventional or synthetic, thus the use of wood results in an improved $CO_2$ acceptor life especially when synthetic $CO_2$ acceptors are used.

Desirably the wood is dried to a moisture content below about 2.0 weight percent prior to charging to reactor 10. Such is desirable to reduce the heat duty on reactor 10 so that less heat is required by the reaction of $CO_2$ with the acceptor.

As known to the art, calcium oxide is the preferred acceptor either as a conventional acceptor or in a synthetic acceptor. The resulting gas has a composition substantially the same as when coals which have a much lower oxygen content are reacted. A typical synthesis gas composition in volume percent is: $H_2$—60%, CO—15%, $CO_2$—9% and $CH_4$—14%. Some process variation may occur but generally compositions approximating a $H_2/CO$ ratio of 3.0 or more will be produced.

While the present invention has been disclosed by reference to certain of its preferred embodiments, it is pointed out that the embodiments set forth are illustrative rather than limiting in nature and that many variations and modifications are possible within the scope of the present invention. Many such variations and modifications may be considered obvious or desirable to those skilled in the art based upon a review of the foregoing description of preferred embodiments.

Having thus described the present invention, we claim:

1. In a process for producing synthesis gas by reacting a solid carbonaceous fuel with steam in the presence of a carbon dioxide acceptor to produce a synthesis gas rich in hydrogen with at least a major portion of the carbon dioxide so produced being reacted with said carbon dioxide acceptor to produce calcium carbonate and to provide sufficient heat to maintain a desired reaction temperature, an improvement comprising; the use of finely-divided wood as said solid carbonaceous fuel and using as the $CO_2$ acceptor, a $CO_2$ acceptor consisting essentially of calcium oxide supported in a refractory carrier matrix, said carrier having the general formula $Ca_5(SiO_4)_2CO_3$ and wherein said calcium oxide is present in an effective amount up to about 50 weight percent based on the weight of said synthetic $CO_2$ acceptor.

2. The improvement of claim 1 wherein said finely-divided wood is of a particle size less than about 4 Tyler mesh.

3. The improvement of claim 2 wherein said finely-divided wood is of a size consist from about 100 to about 8 Tyler mesh.

4. The improvement of claim 1 wherein said wood is dried to a water content below about 2.0 weight percent.

* * * * *